United States Patent [19]
De Bijl et al.
[11] 4,380,719
[45] Apr. 19, 1983

[54] ELECTRONIC DEVICE FOR THE STARTING AND A.C. VOLTAGE OPERATION OF A GAS AND/OR VAPOR DISCHARGE LAMP

[75] Inventors: Adrianus M. J. De Bijl; Hubertus M. J. Chermin, both of Eindhoven, Netherlands

[73] Assignee: U.S. Philips Corporation, New York, N.Y.

[21] Appl. No.: 207,321

[22] Filed: Nov. 17, 1980

[30] Foreign Application Priority Data

Dec. 19, 1979 [NL] Netherlands ..... 7909128

[51] Int. Cl.[3] ..... H05B 41/16
[52] U.S. Cl. ..... 315/101; 315/207; 315/208; 315/244; 315/290
[58] Field of Search ..... 315/101, 207, 208, 225, 315/244, 289, 290, 307, DIG. 7

[56] References Cited

U.S. PATENT DOCUMENTS 3,924,155 12/1975 Vogeli ..... 315/101 X
4,066,932 1/1978 Rottier ..... 315/244
4,253,043 2/1981 Chermin et al. ..... 315/101 X

*Primary Examiner*—Eugene R. La Roche
*Attorney, Agent, or Firm*—Robert T. Mayer; Bernard Franzblau

[57] ABSTRACT

An electronic device (20–61) for the starting and a.c. operation of a capacitively stabilized discharge lamp (7) includes a controlled semiconductor switching element (22) which, in the operating condition of the lamp, is briefly conductive in each half cycle of the AC supply. The control circuit of the semiconductor switching element (22) includes a second switching element (25) which, during the starting procedure of the lamp, ensures that the semiconductor switching element (22) is made conductive only every alternate half cycle thereby to improve the ignition of the lamp.

16 Claims, 1 Drawing Figure

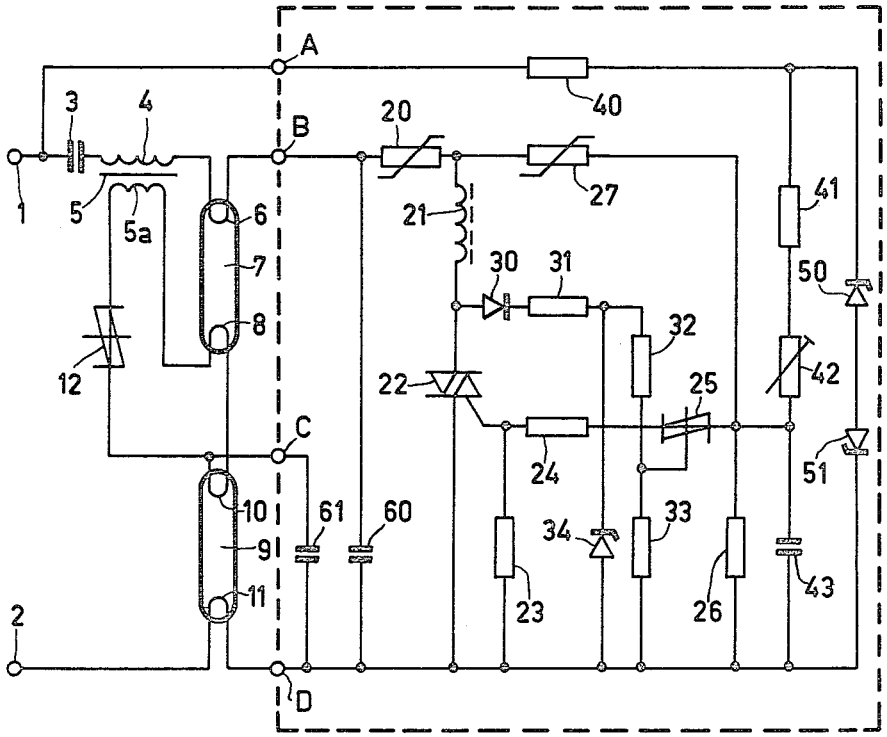
A
B
C
D
1
2
3
4
5
5a
6
7
8
9
10
11
12
20
21
22
23
24
25
26
27
30
31
32
33
34
40
41
42
43
50
51
60
61

ELECTRONIC DEVICE FOR THE STARTING AND A.C. VOLTAGE OPERATION OF A GAS AND/OR VAPOR DISCHARGE LAMP

The invention relates to an electronic device for the starting and a.c. voltage operation of a gas and/or vapour discharge lamp provided with electrodes, the device having at least two input terminals one of which is intended for connection to an electrode of the discharge lamp and another of which is intended for connection to another lamp electrode. The input terminals are interconnected by a circuit branch comprising a first controlled semiconductor switching element provided with a control circuit such that, in the fully operating condition of the lamp with an a.c. voltage applied to said two terminals, the semiconductor switching element is rendered conductive by the control circuit for a period in every half cycle of the applied a.c. voltage. The manner in which the semiconductor switching element is controlled depends on the magnitude of the voltage between the said two input terminals.

The invention also relates to an electric lighting arrangement including a gas and/or vapour discharge lamp provided with two internal electrodes in combination with an electronic device of the type defined in the opening paragraph.

An electronic device of the type indicated is described in the U.S. Pat. No. 4,253,043 (Feb. 24, 1981).

This prior electronic device has the advantage that an electric supply circuit provided therewith for a gas and/or vapour discharge lamp requires only a relatively small stabilisation ballast, which includes a capacitor, arranged in series with the lamp. However, the prior electronic auxiliary device has the drawback that the lamp in the described circuit sometimes refuses to ignite.

It is an object of the invention to provide an electric device of the type defined in the opening paragraph which does not have this drawback, or at least to a lesser extent.

The invention accordingly provides an electronic device for the starting and a.c. voltage operation of at least one gas and/or vapour discharge lamp provided with electrodes, the device having at least two input terminals one of which is intended for connection to an electrode of the discharge lamp and another of which is intended for connection to another lamp electrode. The two input terminals are interconnected by a circuit branch comprising a first controlled semiconductor switching element provided with a control circuit such that in the fully operating condition of the lamp with an a.c. voltage applied to said two terminals, the semiconductor switching element is rendered conductive by the control circuit for a period in every half cycle of the applied a.c. voltage. The manner in which the semiconductor switching element is controlled depends on the magnitude of the voltage between the said two input terminals. The invention is characterized in that the device further includes a second controlled semiconductor switching element having two switching positions (states) and with the second switching element connected to the first switching element so that only in one of the switching positions of the second switching element is the current through the first switching element blocked. A control electrode of the second switching element is connected to a second control circuit which is arranged in parallel with a portion of the circuit branch which interconnects the said two input terminals and comprises at least the first switching element. The second control circuit includes a rectifier and exhibits such a small time constant that, at least immediately after switch-on of the device, the second control circuit causes the second switching element to switch to its other switching position at the beginning of each half cycle.

An advantage of an electronic device in accordance with this invention is that an electric supply circuit for a discharge lamp exhibits an improved ignition characteristic over that of the aforesaid U.S. patent.

The invention is based on the discovery that in the case of the circuit described in the said United States Patent, the presence of a residual charge on the ballast capacitor—at the instant the circuit is switched on—may result in the lamp refusing to ignite. Such a residual charge on the ballast capacitor may, for example, be present if the lamp circuit was switched off very shortly prior to the renewed switching-on operation. This situation may occur when a person, after he has extinguished the illumination, finds that he needs light and consequently switches the circuit on again immediately.

In the prior art circuit said residual charge on the capacitor may, depending on the instant of renewed switch-on, result in a starting voltage being applied to the lamp which is not sufficiently high. This is caused by the fact that the lamp—during starting—is sometimes almost permanently short-circuited by the first switching element. The lamp then refuses to ignite.

This problem might be solved by shunting the ballast capacitor by a highly resistive resistor. The residual charge on the capacitor then leaks away comparatively rapidly across that resistor. This solution has, however, the drawback that the resistor introduces extra losses in the operating condition of the lamp.

In the present invention the solution was sought in the electronic auxiliary device itself. It was recognized that when, during the starting procedure of the lamp, the first semiconductor switching element, which shunts the lamp, is kept in its non-conducting state for a longer period of time, there results a sufficiently high igniting voltage across the lamp, this also being the case in the situation outlined above of a residual charge on the capacitor.

When starting a discharge lamp with an electronic device according to the invention, the operation of the second switching element makes the first switching element conductive only every alternate half cycle of the a.c. voltage supply. In the intermediate half cycles igniting voltages may be produced across the lamp. The operation outlined above of the second switching element is, inter alia, effected by a rectifier in its control circuit.

The second switching element is included in, for example, the branch which interconnects the input terminals of the electronic auxiliary device and which also comprises the first switching element, i.e. that the two switching elements are arranged in series. The second switching element then has, for example, a bi-directional thyristor characteristic ("Triac"), the second switching element then being rendered conductive every alternate half cycle during starting of the lamp. In this situation, after starting of the lamp, a temperature-dependent resistor (NTC) which, for example shunts the second switching element and is in thermal contact with the lamp, can take over current transfer.

The small time constant of the control circuit of the second switching element is obtained, for example, by including an ohmic resistor in series with a relatively small capacitor in that control circuit.

In an embodiment of an electronic device according to the invention the second control circuit comprises a resistance voltage divider, and the control electrode of the second switching element is connected to a tap of that voltage divider. The ratio of the resistance division is such that with an a.c. voltage between the input terminals of the device—which at the most corresponds to the arc voltage of the discharge lamp to be operated therewith—the voltage at the control electrode of the second switching element is insufficient to bring that switching element to an other switching position, the switching position then available being the switching position which is free of a blocking action of the first switching element.

An advantage of this embodiment is that the control circuit of the second switching element (second control circuit) has a very small time constant and that it ensures the transition of the operation of the electronic auxiliary device from the situation of starting the lamp to the situation for the operating condition of the lamp.

In an improvement of this last embodiment of an electronic device according to the invention, the voltage divider in the second control circuit is shunted by a zener diode connected so that the pass-direction of the rectifier and the zener direction of the zener diodes are electrically in the same direction. An advantage of this improvement is that the second switching element is then protected from dangerously high control voltages.

In the foregoing it was stated that the second switching element might be arranged in series with the first switching element. In a further embodiment of an electronic device according to the invention, however, the second switching element is provided in the control circuit of the first switching element. An advantage of this embodiment is that the second switching element need only carry a control current, that is to say that this switching element need be dimensioned only for a low current.

In an improvement of the last embodiment, the control circuit of the first switching element comprises a series arrangement of at least a resistor and a capacitor, and that series arrangement is then connected in parallel with a portion—which at least includes the first switching element—of the branch which interconnects the input terminals. The second switching element is connected between the control electrode of the first switching element and a tapping point on the series arrangement of the resistor and the capacitor. An advantage of this improvement is that the degree to which the last-mentioned capacitor is charged can be controlled by means of the second switching element and that the control of the first switching element can be influenced in a simple manner therewith.

In a still further embodiment of an electronic device according to the invention the second switching element is a breakdown element whose breakdown voltage has a lower value in the presence at the control electrode of that switching element of a control signal which is above a threshold value than in the case that the control signal is absent. An advantage of this is that interference pulses can then be eliminated in a simple manner, more specifically interference pulses which occur in the case of the high breakdown value of the second switching element. It should be noted that in the lastmentioned embodiment the first and the second switching position of the second switching element mean the one and the other breakdown voltage, respectively.

The invention also relates to an electric lighting arrangement including a gas and/or vapour discharge lamp provided with two internal electrodes, and an electronic device according to the invention for starting and operating the lamp, which device is arranged in parallel with the lamp, and in which the arrangement includes two terminals intended for connection to an a.c. voltage source and those terminals are interconnected by a series arrangement of at least the lamp and a stabilization ballast which includes at least a capacitor and a coil.

Finally, the invention also relates to an improvement in the above-mentioned circuit wherein an electrode of the lamp is of a pre-heatable type and the electronic auxiliary device is connected to that end of that electrode remote from the terminals of the circuit. An advantage of this improvement is that pre-heating of the preheatable lamp electrode is now also effected by means of the electronic device. That preheating promotes ignition of the lamp. The electric circuit may be provided with one lamp or with series-arranged lamps.

An embodiment of the invention will now be further explained with reference to the accompanying FIGURE which shows an electric circuit of an electronic device according to the invention, as well as two series-arranged lamps which are started and operated by means of the electronic device.

In the FIGURE the electronic device is the portion enclosed in a rectangle indicated by a broken line.

In the FIGURE, reference numerals 1 and 2 denote terminals intended for connection to an a.c. voltage source of approximately 220 Volts, 50 Hz. Terminal 1 is connected to a capacitor 3. The other side of the capacitor 3 is connected to a coil which comprises a primary winding 4 of a transformer 5. A secondary winding of the transformer is denoted by 5*a*. The other side of the winding 4 is connected to a preheatable electrode 6 of a low-pressure mercury vapour discharge lamp 7. The lamp 7 has a second preheatable electrode 8. A similar low-pressure mercury vapour discharge lamp 9 is arranged in series with the lamp 7. The lamp 9 includes a preheatable electrode 10 and a preheatable electrode 11. The electrode 8 is connected to the electrode 10. The electrode 11 is connected to the input terminal 2.

The secondary winding 5*a* has one end connected to the electrode 8 of the lamp 7 and the other end to the electrode 10 of the lamp 9 via a breakdown element 12, which consists of a (silicon bilateral switch (S.B.S.).

The electronic device has four input terminals A, B, C and D. The two input terminals B and D and their interconnections will be described first.

The input terminal B is connected to the electrode 6 and the input terminal D is connected to the electrode 11. The terminals B and D are connected to those ends of the electrodes which face away from the terminals 1 and 2.

The terminals B and D are interconnected by a series arrangement of a positive temperature coefficient (PTC) resistor 20, a coil 21 and a first controlled semiconductor switching element 22 which has a bidirectional thyristor characteristic ("Triac"). A control electrode of the semiconductor switching element 22 is connected to the terminal D via a resistor 23. A junction between the control electrode of the semiconductor switching element 22 and the resistor 23 is connected to a resistor 24. The other side of the resistor is connected to a second controlled semiconductor switching element 25, which is formed as a S.B.S. (silicon bilateral switch). The other side of the switching element 25 is connected to a resistor 26. The other side of this resistor 26 is connected to the terminal D.

A junction between the PTC resistor 20 and the coil 21 on the one hand and a junction between the second switching element 25 and the resistor 26 on the other hand are interconnected via a voltage-dependent resistor (VDR) 27, which operates as a peak voltage suppressor.

A control circuit of the second switching element 25 comprises a series arrangement of a rectifier 30, a resistor 31 and a voltage divider 32, 33. This series arrangement is in parallel with the first switching element 22. A tapping point between the resistors 32 and 33 of the voltage divider is connected to a control electrode of the second switching element 25. The voltage divider 32, 33 is shunted by a zener diode 34 the zener direction of which has electrically the same direction as the pass-direction of the rectifier 30. The switching element 25 (S.B.S.) is of a type in which, in the absence of a control signal at the control electrode of this element, the breakdown voltage thereof is approximately 8 Volts. In the presence of a sufficiently high control signal at the control electrode the breakdown voltage is, however, only approximately 1 Volt. An equivalent circuit of a S.B.S. is, for example, shown in the "Silicon Controlled Rectifier Manual" of General Electric, 1967, page 81.

Furthermore, a first input branch of the control circuit of the semiconductor switching element 22 consists of a series arrangement of a resistor 40, a resistor 41, a variable resistor 42, and a capacitor 43. This input branch is connected between the terminals A and D. Terminal A is connected to terminal 1. A second input branch of the control circuit of the semiconductor switching element 22 consists of a series arrangement of the resistor 27 and the common capacitor 43. This second input branch shunts the series arrangement of the coil 21 and the first switching element 22.

Furthermore, the series arrangement of the resistors 41, 42 and the capacitor 43 is shunted by a series arrangement of two opposite-directed zener diodes 50 and 51.

Finally, the terminals B and D are interconnected via a radio frequency anti-interference capacitor 60 and the terminals C and D via a capacitor 61. The capacitor 61 is provided to allow the lamps 7 and 9 to ignite sequentially ("sequent-start").

Apart from the control circuit components 30 to 34, inclusive, the described circuit is largely identical to the circuit described in the above-mentioned United States Patent.

The described circuit operates as follows. Let it first be assumed that there is no residual charge on the capacitor 3. When the terminals 1 and 2 are connected to the 220 Volts, 50 Hz voltage source a current will first flow through the circuit 1, 40, 41, 42, 43, 11, 2, causing capacitor 43 to be charged until the breakdown voltage value of the element 25 is obtained across capacitor 43. Due to the presence of the rectifier 30 this will be the low breakdown voltage value when terminal 1 is positive relative to terminal 2, and the high breakdown voltage value when terminal 1 is negative to terminal 2. The switching element 22 is rendered conductive only for the case where the high breakdown voltage value of the element 25 is reached. This is because when the low breakdown voltage of the element 25 is reached the charge on the capacitor 43 is insufficient at that time to render the first switching element 22 conductive therewith via the element 25.

When the switching element 22 is rendered conductive, the capacitor 3 is charged via that element. At zero current crossings the element 22 becomes nonconducting again. As a result of the bias voltage on the capacitor 3 a relatively high voltage is produced between the electrodes 6 and 11. This voltage is of such a high value that the voltage-dependent resistor 27 then assumes its low-ohmic value. This causes the capacitor 43 to be charged fairly rapidly via the then relatively small value resistor 27. When the high threshold voltage of the element 25 is reached again the semiconductor switching element 22 is rendered conductive again, via its control electrode. Then a current flows through the circuit 2, 11, 22, 21, 20, 6, 4, 3 to input terminal 1. Because of the fact that current also flows through the winding 4, a voltage which produces a preheat current for the electrodes 8 and 10 will then be induced in the winding 5*a*. When, at the end of such a half cycle, the current through the element 22 decreases to below its hold current value, then this element is rendered nonconductive again.

Every alternate half cycle in which terminal 1 is negative with respect to terminal 2, the switching element 22 is rendered conductive again via the input circuit 27, 43 in the manner described above. In the intermediate half cycles the switching element 22 remains non-conductive. This process continues until the discharge lamps 7 and 9 ignite. Then the voltage between the electrodes 6 and 11 becomes equal to the combined arcvoltages of the two lamps. This voltage is insufficient to keep the voltage-dependent resistor 27 in its low-ohmic state so that it reverts to the high-ohmic state. The first input branch 40, 41, 42, 43 then assumes the task of rendering the semiconductor switching element 22 conductive. During each half cycle of the power supply the capacitor 43 now is charged via the resistors 40 to 42, inclusive, until the high breakdown value of the threshold element 25 is reached. For the summed arc voltages of the lamps 7 and 9 the control signal at the control electrode of the element 25 is now insufficient to give this element its low breakdown value. The control electrode of the switching element 22 then receives in every half cycle a pulse in response to which this switching element is rendered conductive. The capacitor 3, which forms part of the stabilization ballast, ensures inter alia that a sufficiently high re-ignition voltage always appears across the discharge lamps.

In the starting procedure of the discharge lamps 7 and 9 the operation of the input branch 40, 41, 42 is in effect rapidly blocked because the capacitor 43 is much more rapidly charged via the resistor 27 to reach the high breakdown value of the threshold element 25. Also, if an interference were to occur which would tend to increase the voltage between the electrodes 6 and 11 to a high value, the resistor 27 switches to its low-ohmic state and ensures that the switching element 22 is made conductive sufficiently rapidly to prevent that high voltage from occurring.

If the discharge lamps 7 and 9 have ignited, the voltage across the transformer winding 5*a* is reduced to such an extent that the breakdown value of the element 12 is no longer attained. This terminates the preheating action for the innermost electrodes 8 and 10. Further heating is not necessary in the operating condition of the lamps since the temperature of the electrodes 8 and 10 is already kept at a sufficiently high level by the discharges in the two lamps 7 and 9.

In a practical embodiment, each discharge tube has a length of approximately 1.2 meter and a diameter of approximately 26 mm. The filling gas consists of argon. The arc voltage of each of the two lamps is approximately 125 Volts. In that case each of the lamps consumes approximately 34 W. The stabilisation ballast consisting of the combination 3,4 consumes only approximately 9 W, so that a total of 77 W is taken from the AC supply. The system efficiency, that is to say the efficiency of the entire electric arrangement including the ballast, is then approximately 88 lumen/Watt. During the starting procedure the resistor 27 proceeds to the low-ohmic state when a minimum voltage of approximately 350 Volts appears between the outermost lamp electrodes. This prevents the lamps from igniting while the electrodes are still cold.

In this embodiment the circuit elements have the approximate values specified in the following Table.

| | |
|---|---|
| capacitor 3 (μF) | 3.4 |
| capacitor 43 (nF) | 470 |
| capacitor 60 (nF) | 10 |
| capacitor 61 (nF) | 15 |
| coil 4 (Henry) | 1.4 |
| coil 21 (mHenry) | 1 |
| resistor 23 (kOhm) | 1 |
| resistor 24 (Ohm) | 150 |
| resistor 26 (kOhm) | 27 |
| resistor 31 (kOhm) | 94 |
| resistor 32 (kOhm) | 20 |
| resistor 33 (kOhm) | 10 |
| resistor 40 (kOhm) | 100 |
| resistor 41 (kOhm) | 10 |
| breakdown value element 12 (Volt) | 50 |
| breakdown value element 25 (Volt): | |
| without control signal | 8 |
| with control signal | 1 |

If the described arrangement were not provided with the circuit elements 30 to 34, inclusive, that is to say if the control circuit of the second switching element 25 were absent, a circuit would be obtained which is comparable with the circuit already described in the above-mentioned United States Patent. If, in such a circuit, immediately prior to the connection of the input terminals 1 and 2 to the a.c. voltage source, a residual charge were present on the capacitor 3, then the following situation might be obtained. On applying the a.c. voltage, the residual charge (or initial charge) on the capacitor 3 may be such—and the first time during the lamp starting procedure the switching element 22 is made conductive may occur at such an instant in a period of the a.c. voltage supply—that the first switching element 22 is not rendered non-conductive thereafter. This situation could ariese if, at the instant the switching element 22 should become non-conductive, a new control pulse is applied to this switching element. In that case the lamps 7 and 9 will be permanently shunted by element 22 and, consequently, will not ignite. Such a case might, for example, arise with a combination of a residual voltage of approximately 500 volts across the capacitor 3 and the switching element 22 becoming conductive 5.5 milliseconds after a zero crossing of the ac supply voltage.

In the circuit according to the invention, however, the control circuit 30 to 34, inclusive, ensures that-during the starting procedure of the lamps 7 and 9—the switching element 22 is conductive only in every alternate half cycle, as described above. This prevents permanent shunting of the lamps from occurring under the above-mentioned conditions. The lamps can then ignite.

What is claimed is:

1. An electronic device for the starting and a.c. voltage operation of at least one electric discharge lamp provided with electrodes, the device comprising, at least two input terminals one of which is intended for connection to an electrode of the discharge lamp and the other of which is intended for connection to another lamp electrode, said two input terminals being interconnected by a circuit branch comprising a first controlled semiconductor switching element provided with a control circuit, the control circuit being operative such that, in the fully operating condition of the lamp with an a.c. voltage applied to said two terminals, the semiconductor switching element is made conductive for a period in every half cycle of the applied a.c. voltage, the control of the semiconductor switching element depending on the magnitude of the voltage between the said two input terminals, a second controlled semiconductor switching element having two switching states and connected to the first switching element so that only in a first switching state of the second switching element is the current through the first switching element blocked, means connecting a control electrode of the second switching element to a second control circuit arranged in parallel with a portion of the circuit branch which interconnects the said two input terminals and comprises at least the first switching element, and wherein the second control circuit includes a rectifier and has such a small time constant that, at least immediately after switch-on of the device, the second control circuit causes the second switching element to switch to its first switching state at the beginning of each alternate half cycle of the a.c. voltage.

2. An electronic device as claimed in claim 1 wherein the second control circuit includes a voltage divider in series with said rectifier, means connecting the control electrode of the second switching element to a tap on said voltage divider, the ratio of the resistance division being such that in the presence between the two input terminals of an a.c. voltage-which at the most corresponds to the arc voltage of the discharge lamp to be operated therewith-the voltage at the control electrode of the second switching element is only able to bring said second switching element to its second switching state.

3. An electronic device as claimed in claim 2 wherein the second control circuit includes a zener diode connected in shunt with the voltage divider and with the pass-direction of the rectifier and the zener direction of the zener diode being electrically in the same direction.

4. An electronic device as claimed in claims 1, 2 or 3 wherein the second switching element is connected in the control circuit of the first switching element.

5. An electronic device as claimed in claim 4 wherein the second switching element comprises a voltage breakdown element having first and second values of breakdown voltage in the presence and absence, respectively, of a control signal at the control electrode thereof, said first value of breakdown voltage being lower than said second value.

6. An electronic device as claimed in claim 3, wherein the control circuit of the first switching element comprises a series arrangement of at least a resistor and a capacitor, said series arrangement being arranged in parallel with a portion, which at least includes the first switching element, of the branch which interconnects the input terminals, and wherein the second switching element is coupled between the control electrode of the first switching element and a tapping point on the series arrangement of the resistor and the capacitor.

7. An electronic device as claimed in claims 1, 2, 3 or 6 wherein the second switching element comprises a breakdown element having a breakdown voltage which has a lower value in the presence at the control electrode of said switching element of a control signal which is above a threshold value, than in the absence of said control signal.

8. An electronic lighting arrangement comprising two terminals for connection to an a.c. voltage source, an electric discharge lamp having two internal electrodes with the two terminals interconnected by a series arrangement of at least the lamp and a stabilisation ballast comprising at least a capacitor and a coil, and an electronic deivce as claimed in claims 1, 2, 3 or 6 connected in parallel with the lamp.

9. An arrangement as claimed in claim 8 wherein an electrode of the lamp is of the preheatable type, the electronic device being connected to that end of said electrode which is remote from the two terminals of the circuit.

10. An electronic device as claimed in claims 1 or 2 wherein at least one electrode of the discharge lamp is of the preheatable type and the electronic device has said one input terminal connected to said preheatable electrode so that the first semiconductor switching element provides a preheat current path for said preheatable electrode during a start-up phase of the discharge lamp.

11. An electronic device for starting and operating at least one electric discharge lamp provided with electrodes and connected in series circuit with a ballast device including a capacitor across a pair of a.c. voltage supply terminals, said electronic device comprising, first and second input terminals for connection to one lamp electrode and to another lamp electrode, respectively, a controlled semiconductor switching element having a control electrode, circuit means connecting said semiconductor switching element to said first and second input terminals, a first control circuit coupled to said switching element control electrode and to the a.c. voltage supply terminals for triggering the switching element into conduction in each half-cycle of the a.c. supply voltage in the operating condition of the discharge lamp, said control circuit including means responsive to the voltage between said first and second input terminals for controlling the trigger point of the semiconductor switching element depending on the magnitude of said voltage, a second controlled semiconductor switching element coupled to the first semiconductor switching element to inhibit conduction therein when said second semiconductor switching element is in a first switching state and to allow conduction of the first semiconductor switching element when the second semiconductor switching element is in a second switching state, and a second control circuit coupled to a control electrode of the second semiconductor switching element and connected in parallel with a portion of the circuit means that includes the first semiconductor switching element, said second control circuit including a rectifier connected in circuit so that during the start-up phase of the discharge lamp said second semiconductor switching element is triggered into said first switching state during alternate half-cycles of the a.c. supply voltage.

12. An electronic device as claimed in claim 11 wherein the second control circuit is responsive to the voltage between said first and second input terminals so as to trigger the second semiconductor switching element into the second switching state during each half-cycle of the a.c. supply voltage when the discharge lamp is in the operating condition.

13. An electronic device as claimed in claims 11 or 12 wherein the second semiconductor switching element is a part of the first control circuit and is connected to the control electrode of the first semiconductor switching element to control the triggering thereof.

14. An electronic device as claimed in claims 11 or 12 wherein the discharge lamp includes at least one preheatable electrode, and the first control circuit includes delay means responsive to the voltage between the two input terminals for controlling the trigger point of the first semiconductor switching element during the start-up phase of the lamp so as to delay ignition of the lamp for a time period sufficient to heat said preheatable electrode to a given operating temperature.

15. An electronic device as claimed in claims 11 or 12 wherein the first control circuit comprises first and second input branches connected to said supply terminals and to said input terminals, respectively, and said second input branch includes a non-linear circuit element whose impedance varies as a function of a circuit parameter that varies with the condition of the discharge lamp.

16. An electronic device as claimed in claims 11 or 12 wherein the second semiconductor switching element comprises a voltage breakdown element having a threshold breakdown voltage that is determined by the voltage level at its control electrode, and wherein the voltage level at the breakdown element control electrode is lower in the operating condition of the lamp and is then below said threshold voltage.

* * * * *

UNITED STATES PATENT AND TRADEMARK OFFICE

CERTIFICATE OF CORRECTION

PATENT NO. : 4,380,719

DATED : April 19, 1983

INVENTOR(S) : ADRIANUS M.J. DE BIJL ET AL

It is certified that error appears in the above-identified patent and that said Letters Patent is hereby corrected as shown below:

In the Specification:

Column 1, line 64, after "one" insert --(i.e. the first)--; change "positions" to --states--

Column 2, line 7, change "other" to --first--; change "at the beginning of" to --(state) during each alternate-- line 8, delete "each"; after "cycle" insert --of the AC voltage--

Column 3, line 18, after "." (period) insert

--In other words, when the lamp arc voltage appears at the input terminals, the control voltage for the second switching element is only able to bring it to its second switching state.--

UNITED STATES PATENT AND TRADEMARK OFFICE

CERTIFICATE OF CORRECTION

PATENT NO. : 4,380,719

DATED : April 19, 1983

INVENTOR(S) : ADRIANUS M.J. DE BIJL ET AL

It is certified that error appears in the above-identified patent and that said Letters Patent is hereby corrected as shown below:

In the Claims:

Claim 1, line 31, change "at the beginning of" to --during--

Claim 16, line 4, after "by" insert --and is inversely related to-- line 8, cancel "and is then below said thresh-"

line 9, cancel "old voltage"

Signed and Sealed this

*Nineteenth* Day of *November 1985*

[SEAL]

*Attest:*

DONALD J. QUIGG

*Attesting Officer*

*Commissioner of Patents and Trademarks*